United States Patent [19]

Suzuki et al.

[11] Patent Number: 4,860,363

[45] Date of Patent: Aug. 22, 1989

[54] LOUDSPEAKER SYSTEM

[75] Inventors: Hitoshi Suzuki; Kozo Hara; Shiro Koga; Shigeru Morita, all of Fukushima, Japan

[73] Assignee: Mitsubishi Denki Kabushiki Kaisha, Tokyo, Japan

[21] Appl. No.: 171,224

[22] Filed: Mar. 18, 1988

Related U.S. Application Data

[63] Continuation of Ser. No. 849,829, Apr. 9, 1986, abandoned.

[30] Foreign Application Priority Data

Apr. 12, 1985 [JP] Japan ..... 60-77744
Jun. 24, 1985 [JP] Japan ..... 60-135956

[51] Int. Cl.[4] ..... H04R 5/02

[52] U.S. Cl. ..... 381/89; 381/90; 381/205; 381/188

[58] Field of Search ..... 381/89, 90, 24, 205, 381/188

[56] References Cited

U.S. PATENT DOCUMENTS

| | | | |
|---|---|---|---|
| Re. 31,679 | 9/1984 | Froeschle | 381/89 |
| 2,137,032 | 11/1938 | Snow . | |
| 3,582,553 | 6/1971 | Bose | 381/89 |
| 3,754,618 | 8/1973 | Sasaki | 181/31 B |
| 4,133,975 | 1/1979 | Barker, III | 381/90 |
| 4,475,620 | 10/1984 | Carlsson | 381/90 |
| 4,596,034 | 6/1986 | Moncrieff | 381/89 |
| 4,703,502 | 10/1987 | Kasai et al. | 381/86 |
| 4,764,960 | 8/1988 | Aoki et al. | 381/90 |

FOREIGN PATENT DOCUMENTS

| | | | |
|---|---|---|---|
| 524198 | 5/1931 | Fed. Rep. of Germany | 381/90 |
| 1161952 | 1/1964 | Fed. Rep. of Germany . | |
| 2350835 | 4/1974 | Fed. Rep. of Germany | 381/89 |
| 2455336 | 11/1974 | Fed. Rep. of Germany . | |
| 2738126 | 3/1979 | Fed. Rep. of Germany | 381/90 |
| 2738127 | 3/1979 | Fed. Rep. of Germany | 381/90 |
| 2756299 | 7/1979 | Fed. Rep. of Germany | 381/90 |
| 1199441 | 12/1959 | France | 381/90 |
| 153022 | 1/1979 | Japan | 381/89 |
| 160226 | 12/1979 | Japan | 381/89 |
| 162191 | 9/1983 | Japan | 381/90 |
| 0219293 | 9/1986 | Japan . | |

*Primary Examiner*—Forester W. Isen
*Attorney, Agent, or Firm*—Staas & Halsey

[57] ABSTRACT

The present invention includes a loudspeaker system in which sound radiation axes of two speakers in a single loudspeaker unit form an angle with respect to each other in a horizontal plane to increase the size of a listening area. The horizontal angle can be formed by orienting the sound axes of speakers in the loudspeaker unit at an angle in the range of 15 to 45 degrees from each other. The system also includes a phase adjustment system which adjusts the phase of the speakers in each loudspeaker unit so that the phase of the sound from each speaker in each loudspeaker unit is properly adjusted throughout the increased listening area to provide increased sound presence or spread.

9 Claims, 6 Drawing Sheets

θ
6KHz
12KHz

θ = 0°

θ = 15°

θ = 30°

θ = 45°

θ = 60°
0°
30°
60°
90°
270°
300°
330°
50 40 30 20 10 0
0 10 20 30 40 50

LOUDSPEAKER SYSTEM

This is a continuation of co-pending application Ser. No. 849,829 filed on 4-9-86 now abandoned.

BACKGROUND OF THE INVENTION

1. Field of the Invention

The present invention relates to a loudspeaker system which increases the size of the best listening area and, more particularly, to a loudspeaker system which broadcasts sound into a broader sonic cone by angling the speakers with respect to each other and which is particularly suitable for a television.

2. Description of the Related Art

A conventional loudspeaker 10, as illustrated in FIG. 1, includes a speaker cabinet 12 and one or more speakers 14 and 16 having a sound radiation axis extending forwardly and generally perpendicular to the front face 18 of the cabinet 12. Such a loudspeaker 10 produces a relatively narrow sonic cone in which the sound can be adequately heard. When a pair of loudspeakers 10 is incorporated into a television system 20 including a television 22, the sound radiated from each speaker 10 in the system produces a pattern, as illustrated by the one-dot chain lines of FIG. 3. The best listening area in such a system is the shaded area where the sound patterns from the right and left speakers overlap. When a person is positioned in the shaded listening area, the sound image is properly localized with respect to the television 22, that is, the person hears the sound from the television as if it were radiated from the screen of the television. In such a conventional system, the shaded area of FIG. 3 is very narrow, requiring that everyone watching the television be crowded into the narrow listening area to obtain the best sound localization. If a person is positioned outside the shaded area, the person hears only the sound radiated from the closest speaker, and, as a result, the sound image is separate or dislocated from the television screen. Such a dislocation is annoying to the viewer. In addition, because the broadcast pattern for an individual speaker is different for high and low frequency sound, the perceived spread or presence of the sound is not good, particularly on the edges of the best listening area.

SUMMARY OF THE INVENTION

It is an object of the present invention to provide a loudspeaker system which increases the size of the listening area where the sound from a pair of speakers overlaps.

It is another object of the present invention to increase the best listening in front of a television set so that an increased area will be provided in which sound image and picture image will be properly localized.

It is an additional object of the present invention to increase the sound spread or presence produced by a speaker system.

The above objects can be accomplished by a loudspeaker system in which the sound radiation axes of two speakers in a single loudspeaker unit form an angle with respect to each other in a horizontal plane. The use of two speakers in a single loudspeaker unit that are angled with respect to each other increases the area of the sound cone produced by the speaker unit. when two speaker units with the broadened sound cone are used, the best listening area, where the cones overlap, is increased dramatically. This angle between the speakers in a single unit can be formed by orienting the sound axis of each speaker in the loudspeaker unit at an angle in the range of 15 to 45 degrees from each other. The system also includes a phase adjustment system which adjusts the phase of the speakers in each loudspeaker unit so that the phase of the sound from the loudspeaker unit is properly adjusted throughout the increased listening area, so that the sound spread or presence of the sound is increased along with the increase in the size of the best listening area.

These together with other objects and advantages which will be subsequently apparent, reside in the details of construction and operation as more fully hereinafter described and claimed, reference being had to the accompanying drawings forming a part hereof, wherein like numerals refer to like parts throughout.

Figure 4:
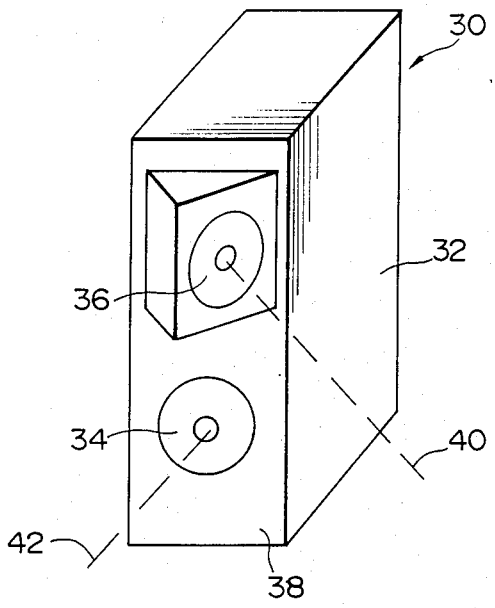
FIG. 4 illustrates a loudspeaker unit 30 in accordance with the present invention.
Figure 8:
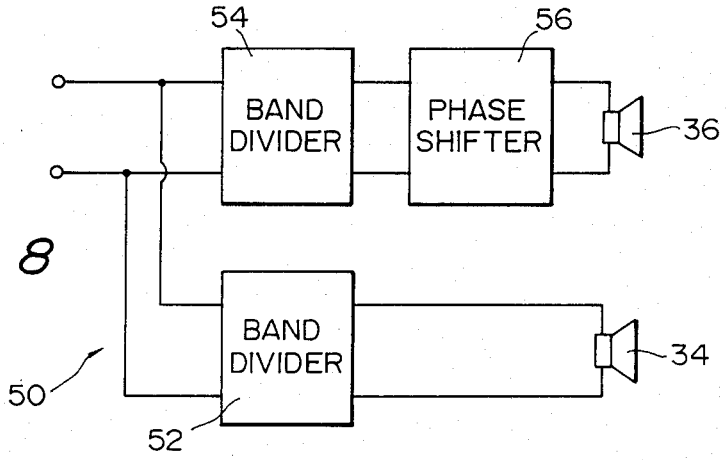
Figure 5:
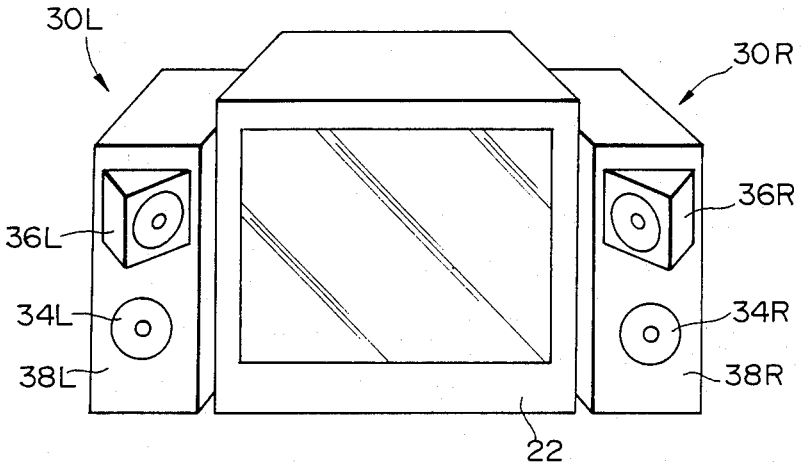
Figure 6:
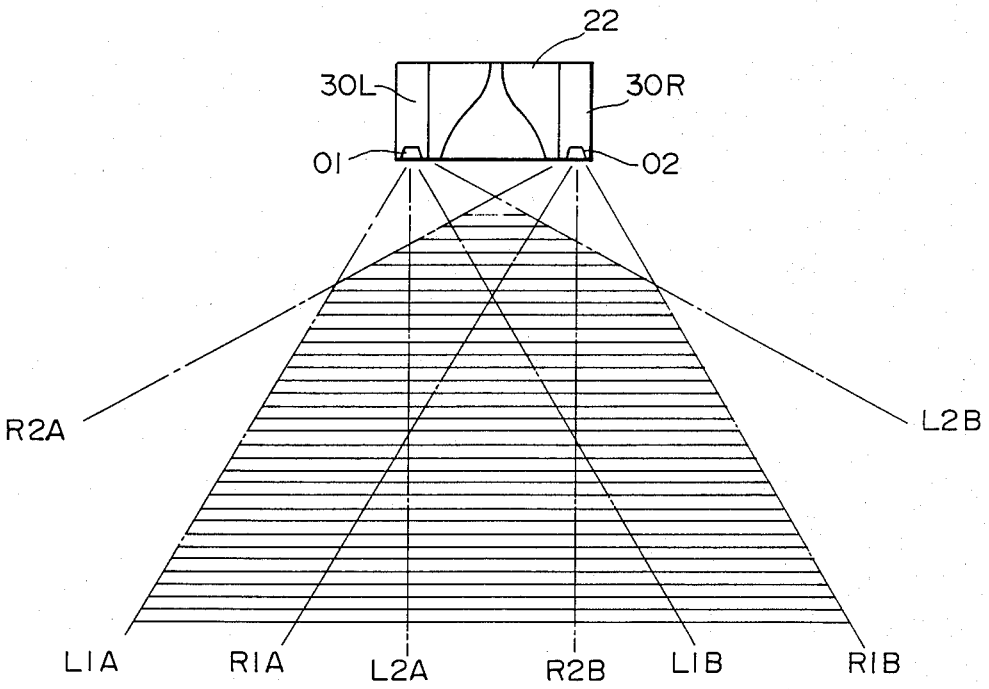
Figures 7A, 7B, 7C, 7D, 7E:
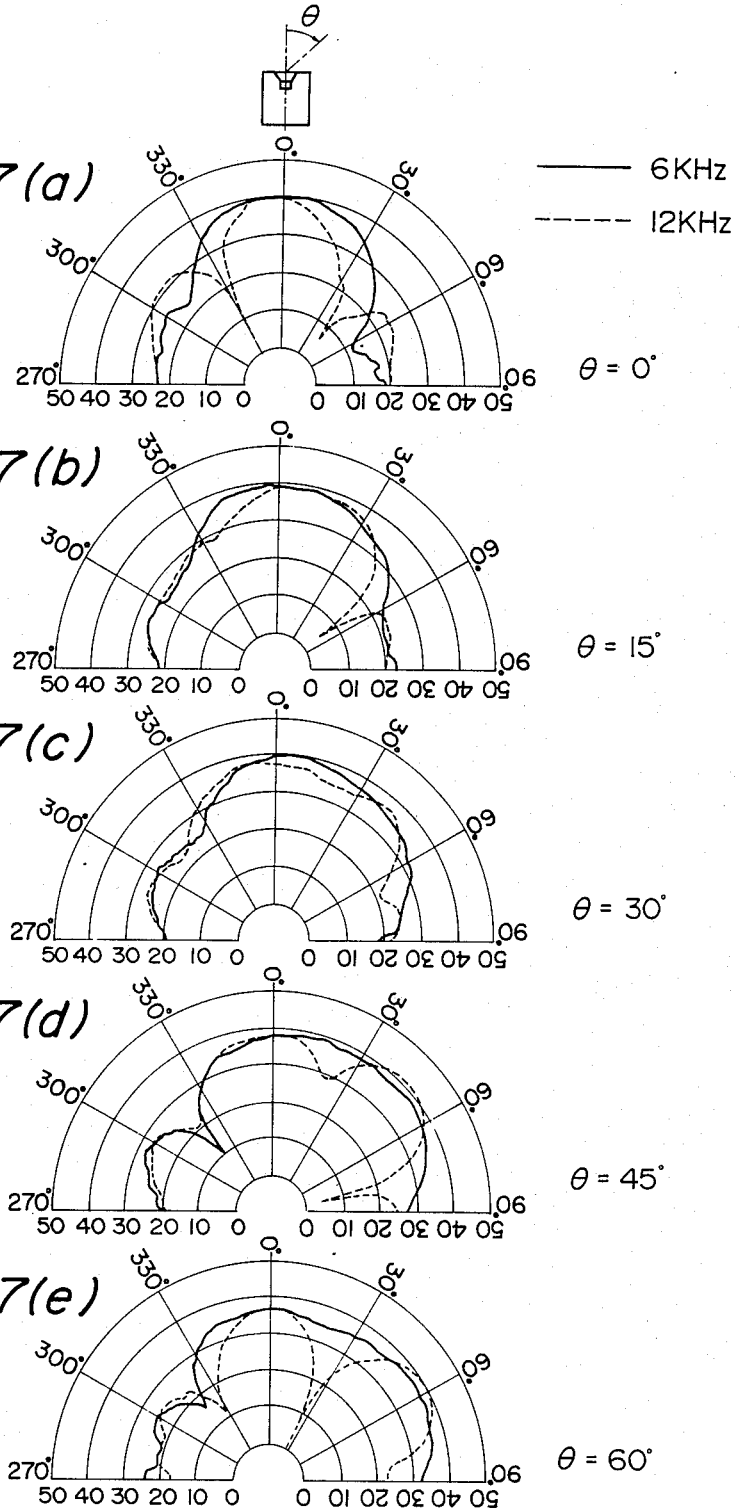
Figure 9A:
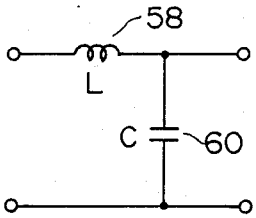
Figure 9B:
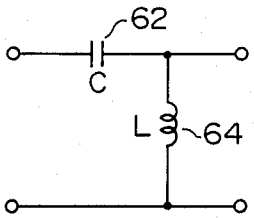
Figure 10A:
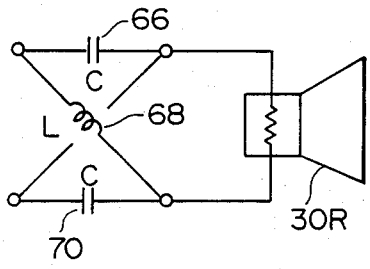
Figure 10B:
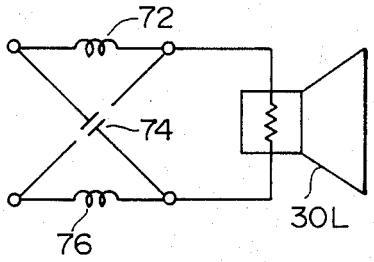
Figure 11:
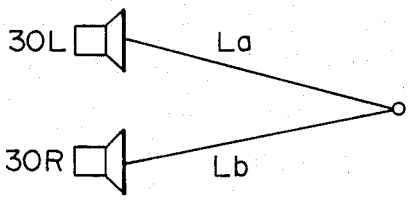
Figure 12:
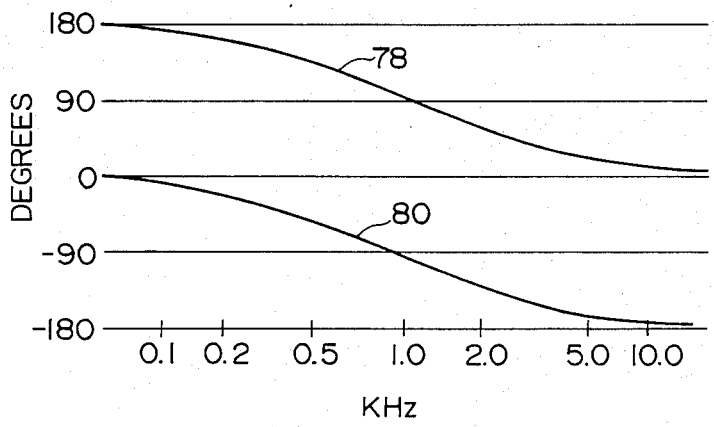

FIG. depicts the loudspeaker unit 30 of the present invention incorporated into a television system;

FIG. 6 shows the sound pattern of the system of FIG. 5;

FIGS. 7(*a*)–7(*e*) illustrate the sound patterns produced by the speaker unit 30 of the present invention as the angle between the sound projection axes of the speakers 34 and 36 is adjusted;

FIG. 8 illustrates a phase control circuit for the speaker 30 of FIG. 4;

FIGS. 9(*a*) and 9(*b*) illustrate the details of band dividing circuits;

FIGS. 10(*a*) and 10(*b*) illustrate the details of phase shift circuits;

FIG. 11 illustrates the concept of phase shifting;

FIG. 12 illustrates a preferred phase shift; and

Figure 13:
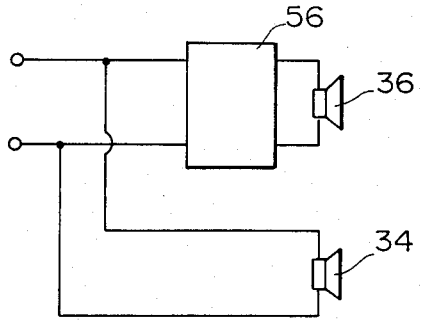

FIG. 13 illustrates another phase control circuit.

DESCRIPTION OF THE PREFERRED EMBODIMENTS

A loudspeaker unit 30 which will increase the size of the sound projection area or cone in accordance with the present invention, as illustrated in FIG. 4, includes a cabinet 32 with speakers 34 and 36 mounted in a front face 38 of the cabinet 32. Upper speaker 36 is mounted in such a manner that its sound projection axis 40 forms an angle, in a horizontal plane with respect to the front face 38 of the cabinet 32 and with respect to the sound projection axis 42 of lower speaker 34.

FIG. 5 illustrates a pair of speakers 30 incorporated into a television 22. FIG. 5 illustrates that the top speaker 36L in the left speaker 30L is angled toward the right, while the top speaker 36R in the right speaker unit 30R is angled toward the left. The resulting sound patterns of the two loudspeaker units 30 are in mirror symmetry with each other and overlap.

Figure 1:
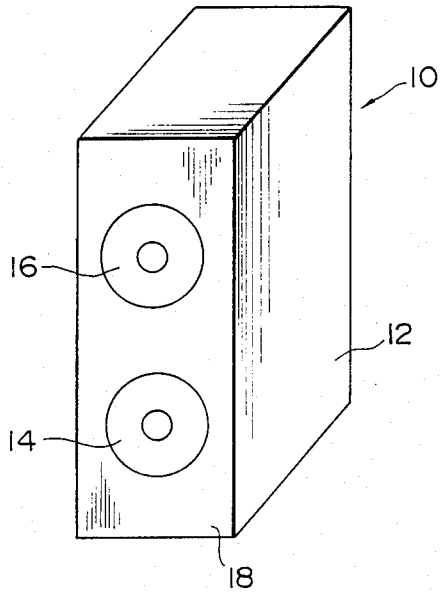
FIG. 1 PRIOR ART
FIG. 1 depicts a conventional multi-speaker loudspeaker unit 10.
Figure 2:
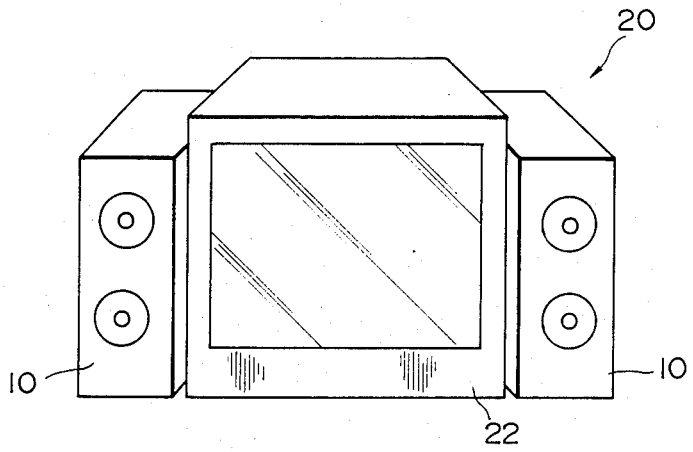
FIG. 2 PRIOR ART
FIG. 2 illustrates the conventional loudspeaker 10 of FIG. 1 incorporated into a television system 20.
Figure 3:
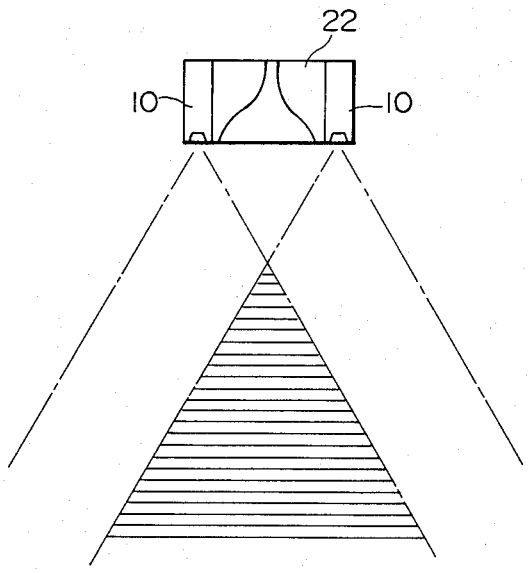
FIG. 3 PRIOR ART
FIG. 3 shows the sound pattern produced by the conventional system 20 of FIG. 2.

The sound pattern produced by the speaker system of FIG. 5 is illustrated in FIG. 6. In the left speaker unit 30L, the bottom left speaker 34L forms a projection pattern with an angle defined by L1A-01-L1B while the upper left speaker 36L forms a projection pattern L2A-01-L2B. the right hand speaker 30R creates a mirror symmetric pattern with the bottom right speaker 34R producing the pattern R1A-02-R1B and the top right speaker 36R producing the pattern R2A-02-R2B. Since the lower speakers 34L and 34R radiate sound generally forwardly of the television 22 and the upper speakers 36L and 36R radiate sound generally across the television 22, the created sound radiation area or cone is larger than that of the conventional loudspeaker illustrated in FIG. 1. If a person is watching the television set 22 while sitting in the enlarged shaded area depicted in FIG. 6, the sound image is localized in the television picture because the right and left loudspeaker sound areas overlap each other.

FIGS. 7(*a*)–7(*e*) illustrate the result of experiments to determine the preferred angle between the sound projection axes 40 and 42 of the upper and lower speakers 34 and 36, respectively. In the experimental system, two all band type speakers ten centimeters in diameter are arranged vertically with the sound radiation axis 42 of the lower speaker fixed in a direction perpendicular to the face 38 of the cabinet 32 and the sound radiation axis 40 of the upper speaker oriented to form angles of 0°, 15°, 30°, 45° and 60° with respect to the sound radiation axis 42 of the lower speaker. At each of the angles, sound energy measurements were carried at a constant distance from the speaker unit 30 using sound broadcast frequencies of 6 kHz and 12 kHz. The results of the measurement with 6 KHz are indicated by the solid line in the polar diagrams of FIGS. 7(*a*)–7(*e*) and the results of the 12 kHz signal measurement by the broken line. As can be seen by reviewing FIGS. 7(*a*)–7(*e*), the polar plots for 15°, 30° and 45° appear to provide the broadest and most uniform sound pattern at both frequencies. The results of the experiment to determine the preferred angle between the speakers when a −10 dB sound pressure level degradation is used as the cutoff level are summarized in Table 1 below:

TABLE 1

EXPERIMENTAL DATA

| Angle between sound radiation axes | Frequency | Angle width with which −10 dB is obtained with respect to the forward direction (0°) | Sound radiation angle of loudspeaker unit | Remarks |
|---|---|---|---|---|
| 0° | 6 kHz | about 73° | front direction (0°) | |
| | 12 kHz | about 45° | front direction (0°) | |
| 15° | 6 kHz | about 87° | in a direction of about 10° | |
| | 12 kHz | about 68° | in a direction of about 10° | |
| 30° | 6 kHz | about 95° | in a direction of about 20° | |
| | 12 kHz | about 97° | in a direction of about 15° | |
| 45° | 6 kHz | about 120° | in a direction of about 30° | |
| | 12 kHz | about 102° | in a direction of about 20° | |
| 60° | 6 kHz | 125° or more | in a direction of about 35° | |
| | 12 kHz | about 40° and about 48° | Null point, in a direction of 25° | Lobe, split into two parts |

As is apparent from FIG. 7 and Table 1, when the angle between the sound radiation axes of the speakers is from 15 to 45 degrees, the directional patterns are relatively broad and satisfactory at both the 6 kHz and 12 kHz frequencies. However, when the angle reaches 60° and the measurement frequency is 12 kHz, the sound pressure lobe is divided into two parts. In the directional pattern obtained when the angle is 45° and the sound frequency is 12 kHz, the sound pressure lobe tends to split into two lobes at an angle of 20°; however, the single partial split in the lobe causes no apparent problem for the user. If the lobe splits more than once, the tone characteristics of the signal will be degraded. Thus, it can be seen that the sound quality will be acceptable when the angle between the speakers is in the range of 15° to 45° with 30° being the most preferable.

As can be seen by reviewing FIGS. 7(*a*)–7(*e*) and Table 1, when the broadcast frequency is low, the sound directional pattern is broad and when the broadcast frequency is high, peaks and dips tend to occur in the pattern. In addition, the sound radiation angle (the average sound projection axis) of the speaker unit shifts as the broadcast frequency changes. To smooth or remove these deviations in the sound pattern and to prevent sound radiation angle shifting, the present invention includes a correction circuit 50, as illustrated in FIG. 8. The correction circuit 50 includes two band dividers 52 which cause a band division at approximately 400 Hz and 12 KHz. This causes higher sound frequencies to be conducted throughout the lower speaker 34 while more of the lower frequencies are emitted by speaker 36. The band division frequencies or the cutoff frequency of a band divider type filter must take into consideration the frequency characteristics of the speaker being used which includes the range of frequencies which need to be phase shifted to correct the variations in sound projection by the speakers as illustrated in FIG. 7. Typical portions of a band divider circuit which will provide high frequency cutoff or low frequency cutoff are respectively illustrated in FIGS. 9(*a*) and 9(*b*). One of ordinary skill in the art can select the appropriate component values based on the speakers used in the system.

In addition to the band dividers 52 an all frequency pass phase shifter 56 is connected between band divider 54 and the top speaker 36. This phase shifter 56 provides an average preferred phase shift of 90° at 2 KHz as compared to the sound waves produced by speaker 34. FIGS. 10(*a*) and 10(*b*) illustrate typical phase shift circuits for the right 30R and left 30L speaker units. The object of the phase shifting is to make the distance from one speaker and the listener and the other speaker and the listener correspond to a phase shift of 90°. That is, the phase shift should obey the following equation: La-Lb-wavelength/4, where La and Lb are the distances from the speaker units 30L and 30R to the listener. An appropriate phase shift pattern for the left 30L and right 30R speakers is illustrated by the curves 78 and 80 in FIG. 11. One of ordinary skill in the art can provide appropriate components to adjust each phase shifter 56 to provide the above preferred amount of phase shift for the speakers actually used. The use of such a phase shifting arrangement compensates for the small lobes and dips in the sound pattern and provides a more uniform increased size listening area. The phase shifter 56 not only corrects the dips and lobes in the sound pattern but increases the perception of the spreading of the sound out over the picture or the presence feeling provided by the sound.

In FIG. 13, a phase shifter 56 is connected to the speakers. In this embodiment, speakers 36 and 34 have substantially the same reproducible frequency band. On the other hand, according to the embodiment shown in FIG. 8, the speakers have partially the same reproducible frequency band. The band divider 54 is a high-pass filter capable of reproducing frequencies greater than 400 Hz. The band divider 52 is a low-pass filter capable of reproducing frequencies lower than 12 KHz. With this structure, sounds in a range of 400 Hz and 12 KHz are reproduced through the speakers 36 and 34, so that audible range can be effectively enlarged with respect to vocal band.

The many features and advantages of the invention are apparent from the detailed specification and thus, it is intended by the appended claims to cover all such features and advantages of the invention which fall within the true spirit and scope thereof. Further, since numerous modifications and changes will readily occur to those skilled in the art, it is not desired to limit the invention to the exact construction and operation illustrated and described, and accordingly, all suitable modifications and equivalents may be resorted to, falling within the scope of the invention. For example, the discussion indicates the top speaker 36 in each speaker unit 30 is the angled speaker; however, it is possible to angle the bottom speaker 34 instead of the top speaker 36 and produce the increased size best listening area. In addition, it is possible to provide different amounts of phase shift and to band divide at different points and still obtain a high quality, high presence, well localized sound image. It is also possible to have two or more speakers in a speaker unit each having a different frequency band.

What is claimed is:

1. A loudspeaker unit, comprising:

a first speaker mounted in the unit, having a first sound projection axis and a sound reproduction bandwidth;

a second speaker mounted in the unit in a vertical direction with respect to said first speaker, having a sound reproduction bandwidth the same as said first speaker and a second sound projection axis, the first and second sound projection axes forming a projection angle therebetween in a horizontal direction; and phase shifting means, operatively connected to said first speaker, for phase shifting the sound produced by said first speaker compared to the sound produced by said second speaker by a phase angle.

2. A loudspeaker as recited in claim 1, wherein the phase angle averages approximately ninety degrees.

3. A loudspeaker as recited in claim 2, wherein the horizontal projection angle is greater than or equal to 15 degrees and less than or equal to 45 degrees.

4. A loudspeaker system, comprising:

a left loudspeaker unit comprising:

a left enclosure having a front face;

a first speaker mounted in said left enclosure, having a first sound projection axis perpendicular to the front face of said left enclosure and a sound reproduction bandwidth; and a second speaker mounted in said left enclosure in a vertical direction with respect to said first speaker, having a sound reproduction bandwidth the same as said first speaker and a second sound projection axis projecting rightward of the first sound projection axis by a horizontal angle;

a right loudspeaker unit spaced apart to the right from said left loudspeaker unit and comprising:

a right enclosure having a front face;

a third speaker mounted in said right enclosure, having a third sound projection axis perpendicular to the front face of said right enclosure and the same sound reproduction bandwidth as said first speaker; and a fourth speaker mounted in said right enclosure in a vertical direction with respect to said third speaker, having a sound reproduction bandwidth the same as said first speaker and a fourth sound projection axis projecting leftward of the third sound projection axis by the horizontal angle;

left unit phase shift means, operatively connected to said second speaker, for phase shifting the sound from said second speaker compared with the sound from said first speaker by a phase angle; and right unit phase shift means, operatively connected to said fourth speaker, for phase shifting sound from said fourth speaker compared with sound from said third speaker by the phase angle.

5. A loudspeaker system as recited in claim 4, wherein the phase angle average approximately ninety degrees.

6. A loudspeaker system as recited in claim 5, wherein high frequency sound is phase shifted more than low frequency sound.

7. A loudspeaker system, comprising:

a left loudspeaker unit comprising:

a left enclosure having a front face and only first and second speakers;

the first speaker mounted in said left enclosure, having a first sound projection axis perpendicular to the front face of said left enclosure and a sound reproduction bandwidth;

the second speaker mounted in said left enclosure in a vertical direction with respect to said first speaker, having a sound reproduction bandwidth the same as said first speaker and a second sound projection axis projecting horizontally and rightward of the first sound projection axis by a horizontal angle; and left unit phase shift means, operatively connected to said second speaker, for phase shifting the sound from said second speaker compared with the sound from said first speaker by a phase angle; and a right loudspeaker unit spaced apart to the right from said left loudspeaker unit and comprising:

a right enclosure having a front face and only third and fourth speakers;

the third speaker mounted in said right enclosure, having a third sound projection axis perpendicular to the front face of said right enclosure and the same sound reproduction bandwidth as said first speaker;

the fourth speaker mounted in said right enclosure in a vertical direction with respect to said third speaker, having a sound reproduction bandwidth the same as said first speaker and a fourth sound projection axis projecting horizontally and leftward of the third sound projection axis by the horizontal angle; and right unit phase shift means, operatively connected to said fourth speaker, for phase shifting sound from said fourth speaker compared with sound from said third speaker by the phase angle.

8. A loudspeaker system as recited in claim 7, wherein the horizontal angle is greater than or equal to 15 degrees and less than or equal to 45 degrees.

9. A loudspeaker as recited in claim 7, wherein the phase angle equals La-Lb-sound wavelength/4 where La and Lb are the respective distances from the left and right loudspeaker units to the listener.

* * * * *

UNITED STATES PATENT AND TRADEMARK OFFICE

CERTIFICATE OF CORRECTION

PATENT NO. : 4,860,363

DATED : August 22, 1989

INVENTOR(S) : Hitoshi Suzuki, et al

It is certified that error appears in the above-identified patent and that said Letters Patent is hereby corrected as shown below:

Col. 1, line 65, ". when" should read --. When--.

Col. 2, line 27, after "FIG." insert --5--;

line 58, after "speaker" insert --unit--;

line 68, ". the" should read --. The--.

Signed and Sealed this

Seventeenth Day of July, 1990

*Attest:*

HARRY F. MANBECK, JR.

*Attesting Officer*

*Commissioner of Patents and Trademarks*